US006487300B1

(12) United States Patent
Lee et al.

(10) Patent No.: US 6,487,300 B1
(45) Date of Patent: Nov. 26, 2002

(54) VIBRATION SPEAKER

(75) Inventors: In Ho Lee; Tae Hyeong Lim; Yeon Ho Son; Seuk Hwan Chung, all of Suwon-Shi (KR)

(73) Assignee: Samsung Electro-Mechanics Co., Ltd., Shi-Kyungki-Do (KR)

( * ) Notice: Subject to any disclaimer, the term of this patent is extended or adjusted under 35 U.S.C. 154(b) by 0 days.

(21) Appl. No.: 09/577,327

(22) Filed: May 24, 2000

(30) Foreign Application Priority Data

Dec. 17, 1999 (KR) ..... 99-58481

(51) Int. Cl.[7] ..... H04R 25/00
(52) U.S. Cl. ..... 381/396; 381/431; 340/407.1
(58) Field of Search ..... 381/151, 396, 381/412, 152; 340/388.1, 384.1, 311.1, 407.1, 825.46

(56) References Cited

U.S. PATENT DOCUMENTS

| | | | | | |
|---|---|---|---|---|---|
| 4,728,934 | A | * | 3/1988 | Pfander et al. | 340/407 |
| 5,511,132 | A | * | 4/1996 | Yoshimi | 381/205 |
| 5,528,697 | A | * | 6/1996 | Saito | 381/192 |
| 5,894,263 | A | * | 4/1999 | Shimakawa et al. | 340/388.1 |
| 6,208,237 | B1 | * | 3/2001 | Saiki et al. | 340/388.1 |
| 6,211,775 | B1 | * | 4/2001 | Lee et al. | 340/407.1 |

FOREIGN PATENT DOCUMENTS

| | | |
|---|---|---|
| JP | 10-14195 | 1/1998 |
| JP | 10-117472 | 5/1998 |
| JP | 10-229596 | 8/1998 |
| KR | 98-22244 | 6/1998 |
| KR | 98-22659 | 6/1998 |
| KR | 98-23812 | 6/1998 |
| KR | 98-23815 | 6/1998 |

* cited by examiner

*Primary Examiner*—Sinh Tran
(74) *Attorney, Agent, or Firm*—Darby & Darby

(57) ABSTRACT

A vibration speaker layout is disclosed to maximize vibration quantity as vibration member is made feasible of resonation in vertical direction by individually furnishing signal input devices for sound generation and vibration generation respectively, which layout comprises a case 10; a vibration plate 20 in order to generate sound, the outside edge of which vibration plate is adfixed to top part of case 10; a voice coil 30 wound cylindrically whose top is adfixed to vibration plate 20; a vibration member 40 composed of magnet 41 and yoke 42 which vibration member is furnished under voice coil 30, which magnet is polarized up and down into N and S poles respectively, and which yoke constitutes magnetic circuit, having been attached to the magnet; an elastic member 50 that elastically supports between the vibration member and the case so that the vibration member may move up and down vertically; and a coil 60 of single phase to generate vibration which coil is attached to bottom surface of the case, facing the vibration member at bottom part of the vibration member so that this coil may drive the vibration member up and down vertically by interaction with the vibration member; whence formation is so that sound be generated by oscillating vibration plate 20 making high-frequency electric current to be applied through voice coil 30 at time of high-frequency signal input while vibration be generated by driving vibration member 40 up and down making low-frequency electric current to be applied through coil 60 to generate vibration at time of low-frequency signal input.

10 Claims, 7 Drawing Sheets

VIBRATION SPEAKER

BACKGROUND OF THE INVENTION

1. Field of the Invention

The present invention relates to a vibration speaker contained in portable communication instruments such as a portable telephone or pager, which speaker performs not only sound function but also vibration function at the same time.

2. Description of the Prior Art

Generally speaker is sound-generating instrument that outputs sound signal received electrically and electronically or bell or melody inputted beforehand into sound hearable by man.

Such speaker is usually not only used as large size phonation media that greatly amplifies sound volume as being connected to audio system or amplifier but also used very much as small size phonation media as having been very much miniaturized.

Particularly speaker applied at small size communication instruments such as portable telephone or pager is usually called also microspeaker as size is formed innovatively small.

By the way, as small size communication instruments such as portable telephone or pager are becoming more and more miniaturized, microspeaker is also more and more miniaturized to adequately correspond to trend.

FIG. 1 shows an example of microspeaker mainly used in existing portable communication instruments which speaker is composed of largely case 1, magnet 2 contained in this case 1, voice coil 3 and vibration plate 4.

Speaker generates sound as voice coil 3 moves up and down owing to magnetic field formed by interaction between voice coil 3 and magnet 2 if high-frequency electric current is applied at voice coil 3 through lead wire from outside, whence vibration plate 4 where an end of voice coil 3 is attached vibrates finely.

To make a more detailed explanation, because high-frequency electric current applied at voice coil 3 through lead (wire) is alternating current, if magnetic field generated by voice coil 3 according to electric current applied at voice coil 3 is formed in same directionality with that formed according to magnet 2, voice coil 3 moves downward to magnet 2 side as attractive force is generated that attracts each other between magnet 2 and voice coil 3.

Contrarily if magnetic field generated by voice coil 3 according to electric current applied at voice coil 3 is formed in opposite directionality with that formed according to magnet 2, voice coil 3 is pushed upward from magnet 2 side as repulsive force is generated that pushes out each other between magnet 2 and voice coil 3.

As voice coil 3 goes up and down according to magnetic field variation applied at voice coil 3 as explained above, vibration plate 4 attached to voice coil 3 vibrates up and down which phenomenon is discharged outward so that sound is generated to perform phonation function.

On the other hand, vibration means is also made to be furnished at the same time together with the above speaker in portable communication instruments in aspect of care of ambiend people so that alarm may be felt not by sound but by vibration; whence the most often used vibration means is vibration motor.

But because recently there is essential need for miniaturization and slimmerization of communication instruments as described before, each part materials contained in these communication instruments must also correspond to it.

What is recently suggested for this is vibration speaker where vibration function is added to speaker, whose typical examples are reported in Japanese Published Official Patent Notices Heisei 10-14195, Heisei 10-117472 and Heisei 10-229596.

All those already applied for invention patent generate sound or induce vibration according to action by which high- or low-frequency electric current is selectively applied to voice coil 3 as shown in FIG. 2 to FIG. 4.

Namely sound is generated or vibration is induced according to frequency of electric current applied at voice coil 3 by way of vibration width. of vibration plate 4 where an end of voice coil 3 is attached in FIG. 2, while in FIG. 3 and FIG. 4, sound is generated by vibrating vibration plate 4 when electric current applied at voice coil 3 is high frequency but vibration is to be felt as vibration member 5 vibrates where magnet 2 is integrally attached so that this vibration is transmitted to outer case when low-frequency electric current is applied.

Magnetic field must be precisely considered which shall be generated at voice coil 3 in order to induce sound and vibration by making electric current to be inputted only at voice coil 3 as explained above.

Namely sound generation is lowered as vibration width is decreased as vibration plate 4 weight is increased where voice coil 3 is attached if coil winding number goes to be increased while the coil winding number should be large enough to increase electric current amount flowing at voice coil 3.

Contrarily vibration amount is decreased as vibration width of vibration member 5 is decreased that shall resonate when electric current is inputted if voice coil 3 winding number is reduced.

Therefore the above previous applied invention patents have demerit that vibration amount is decreased in relatively low frequency band and the output vibration sensitivity is not good because voice coil 3 is wound with reference to sound loudness according to vibration plate 4.

On the other hand this applicant has already proposed Korean Patent applications No. 98-22244, Nos. 98-23812 through 98-23815 and No. 98-22659 in order to solve the above disadvantage in which propositions this applicant has separately furnished coils where high- and low-frequency electric currents are inputted respectively.

Namely here high-frequency electric current to generate sound by oscillating the vibration plate is applied to voice coil attached at vibration plate while low-frequency electric current to generate vibration is applied to vibration coil separately furnished at vibration member bottom so that electric current supply (amount in low frequency band is maximized for vibration force to be maximized.

But in those prior applications there is a problem that the vibration amount is not made large enough to be sensed outside because the vibration induced by electric current applied to the vibration coil as a vibration member furnished upon the vibration coil exhibits a seesaw or rocking action.

Namely if vibration member is to be oscillated by seesaw action, vibration member will move in direction of mutual balance of both sides so that weight cannot be made of maximum utilization; and particularly action shaft at time of the seesaw action acts as vibration load so that it rather causes vibration volume reduction.

SUMMARY OF THE INVENTION

Main purpose of present invention is to maximize vibration quantity as vibration member is made feasible of resonation in vertical direction by individually furnishing signal input devices for sound generation and. vibration generation respectively.

This invention to achieve the above purpose comprises a case, a vibration plate in order to generate sound, the outside edge of which vibration plate is affixed to top part of the case, a cylinder-shaped voice coil whose top is fixedly connected to lower surface of the vibration plate, a vibration member where magnet and yoke is combined integrally, which magnet is polarized up and down at bottom of the voice coil, and which yoke constitutes magnetic circuit, having been attached to the above magnet, a vibration coil wound in single phase so as to resonate in up-and-down direction by interaction with the vibration member, which vibration coil is attached to bottom surface of the above case at bottom part of the vibration member connecting this vibration member with the case.

BRIEF DESCRIPTION OF. THE DRAWINGS

DESCRIPTION OF THE PREFERRED EMBODIMENTS

This invention relates vibration speaker simultaneously retaining sound and vibration functions.

Figure 1:
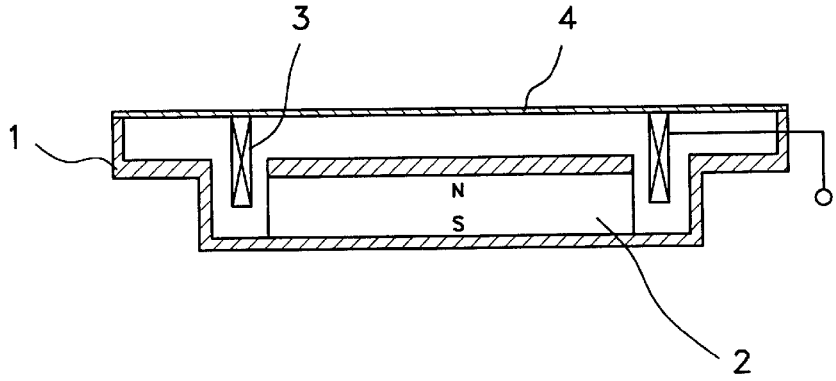
FIG. 1 is a side cross sectional view showing traditional microspeaker.
Figure 2:
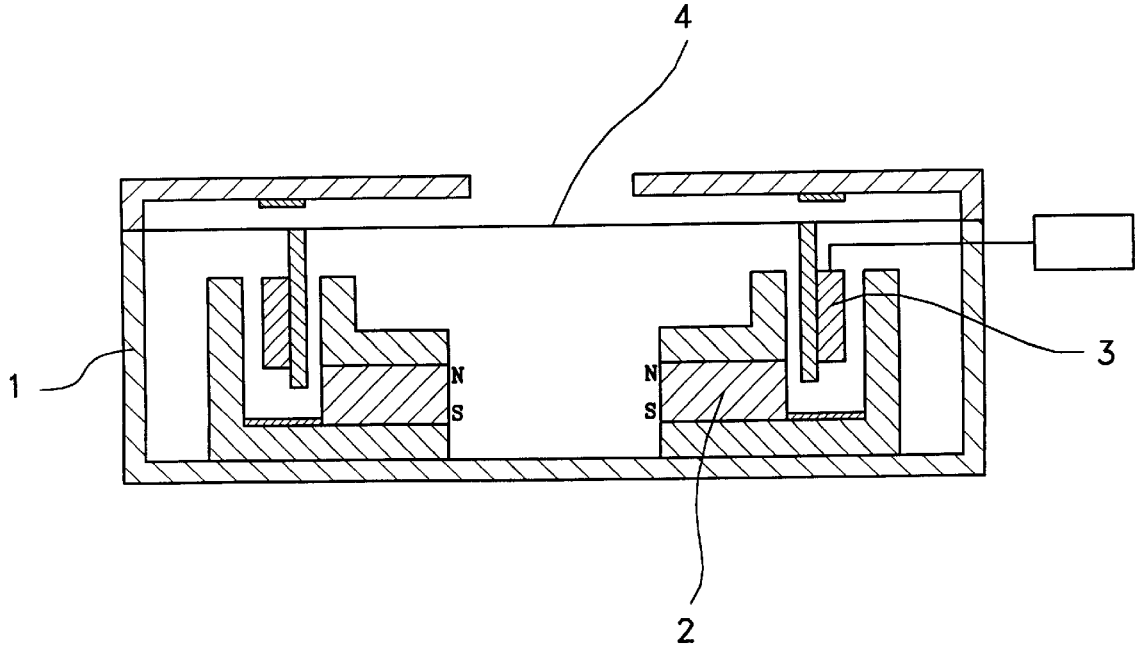
FIG. 2 to FIG. 4 are side cross sectional views showing traditional vibration speaker.
Figure 3:
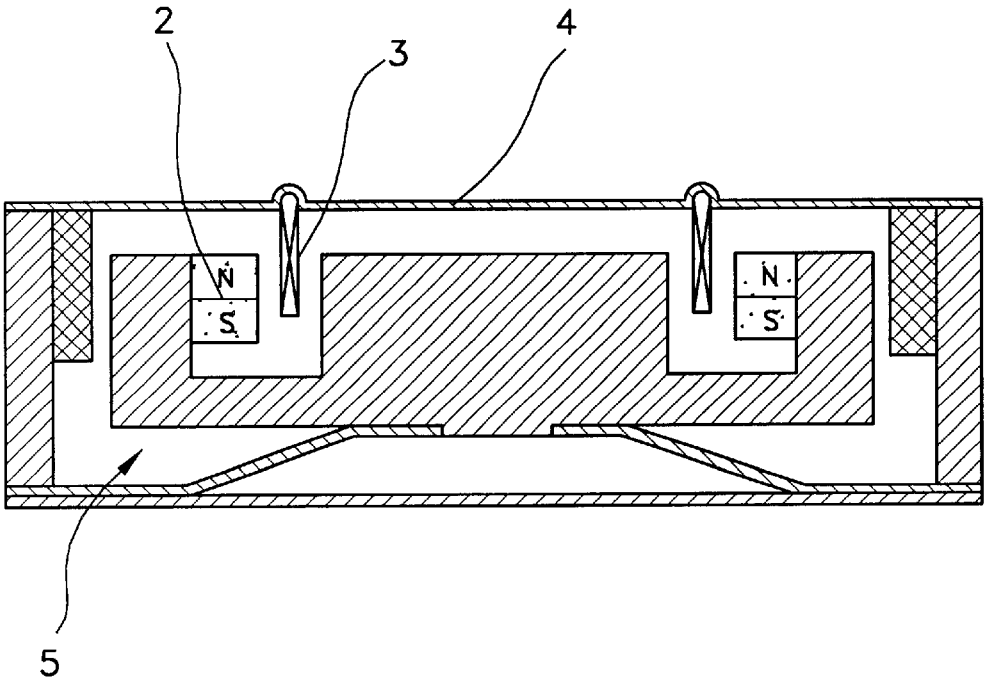
Figure 4:
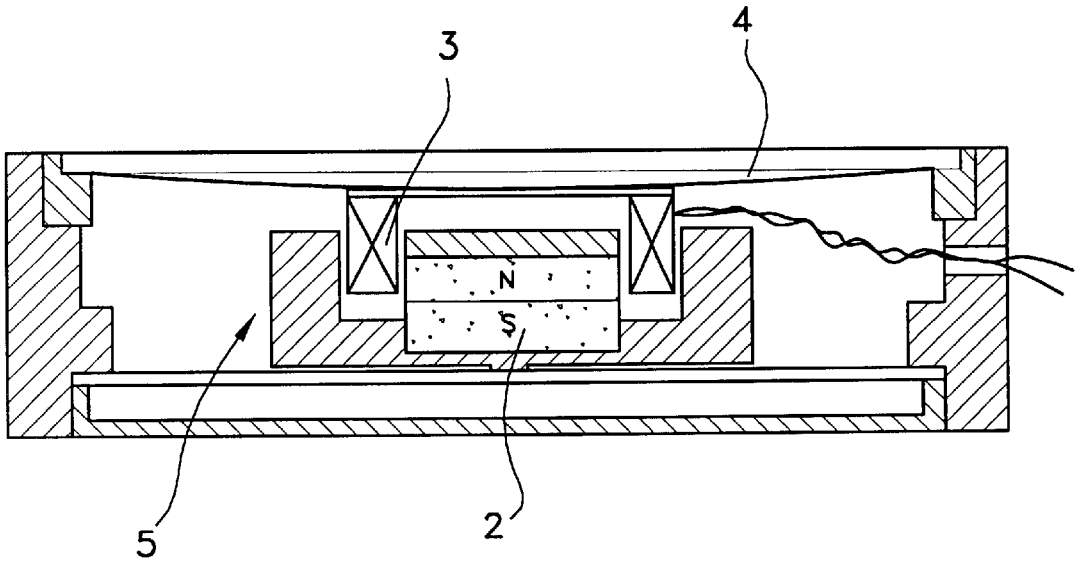
Figure 5:
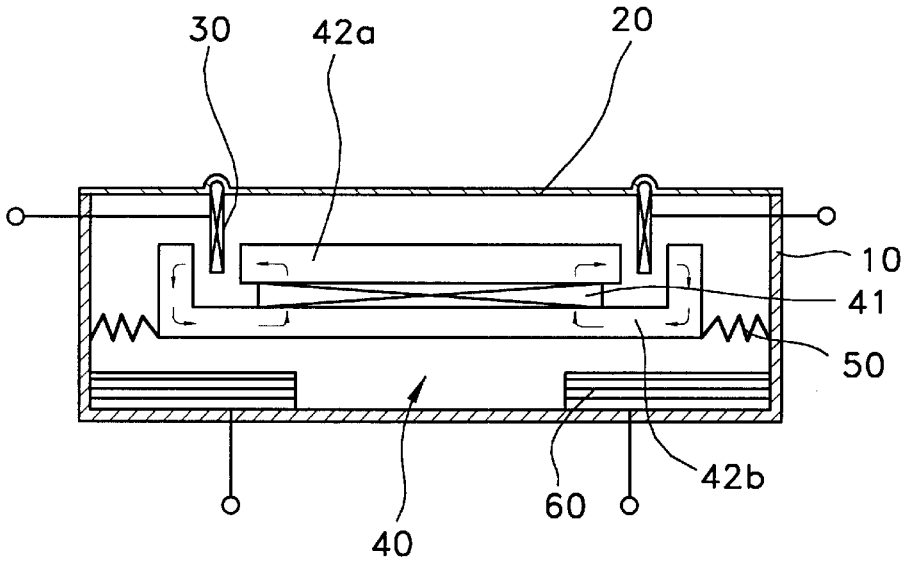
FIG. 5 is a side cross sectional view showing an example of a vibration speaker according to the present invention.

This invention has formation comprising a box type case 10 enveloping outside of the whole, inside which case 10 are contained a vibration plate 20, a voice coil 30 to generate sound, a vibration member 40, an elastic member 50 and a coil 60 to generate vibration as in FIG. 5.

Case 10 is hollow box type member whose top part is ordinarily shielded by cover where sound discharge hole is ordinarily formed.

Figure 6:
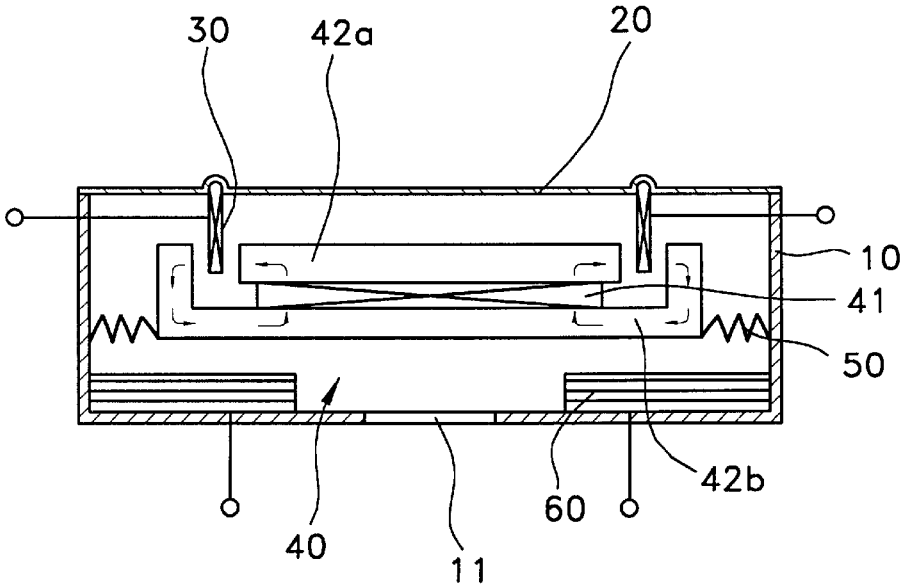
FIG. 6 is a side cross sectional view showing another example of case in vibration speaker of FIG. 5.

This case 10 has one or more sound discharge holes 11 at bottom side in order to smoothly transmit vibration sound from inside of the case 10 to outside of it as shown in appended FIG. 6, the position of which holes 11 is not restricted to case 10 bottom surface but may be applied to various positions.

Vibration plate 20 is thin plate member, which generates sound as the plate surface vibrates up and down, and whose outside edge part is affixed to case 10 top part.

Voice coil 30 is formation of coil wound in cylindrical shape which is ordinarily wound on bobbin whose top part is ordinarily attached to vibration plate 20 bottom surface, to which coil 30 high-frequency alternating current of electricity is applied which frequency is in audible frequency band.

Such layout is same as traditional structure of speaker to generate sound using voil coil.

But only characteristics of present invention is to furnish vibration member 40 as lower part to voice coil 30 and to furnish at the same time coil 60 to generate vibration in lower part of vibration member 40.

Vibration member 40 is formation composed of magnet 41 to which a yoke 42 is attached, which magnet 41 is polarized in N and S poles up and down and to which magnet 41 yoke 42 is attached at least at one pole surface so that magnetic circuit is formed through magnet 41 and voice coil 30.

By the way vibration member 40 is furnished with first yoke 42*a* and second yoke 42*b* on top and bottom surfaces of magnet 41 respectively as in FIG. 5 where first yoke 42*a* of upper side is formed with smaller diameter than inner diameter of voice coil 30, a part of which first yoke 42*a* is inserted in inner diameter part at bottom part side of voice coil 30 while second yoke 42*b* of lower side is formed with larger diameter than inner diameter of voice coil 30, a part of which first yoke 42*a* is inserted in inner diameter part at bottom part side of voice coil 30, the outside end part of which second yoke 42*b* is extended by folding upward, which extended end part then is in separated state from outer diameter surface of voice coil 30 by definite gap in between.

Figure 7:
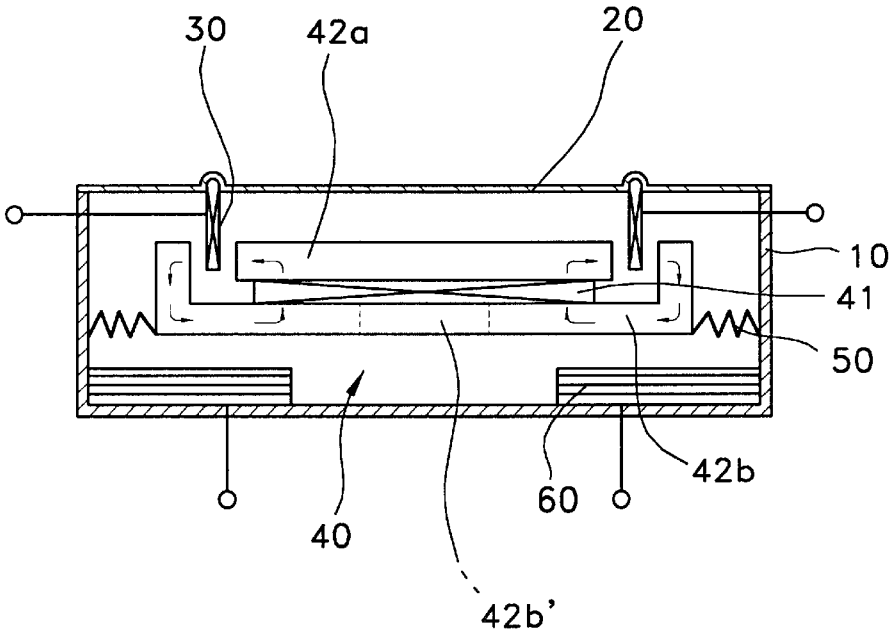
FIG. 7 is a side cross sectional view showing another example of yoke in vibration member of FIG. 5.

Whereupon it is preferable to form a throughhole 42*b*' of definite size at center part of second yoke 42*b* as shown in FIG. 7 so that magnet 41 magnetic force would act actively in downward direction where throughhole 42*b*' is for augmentation of interaction with coil 60 to generate vibration which will be explained later.

Figure 9:
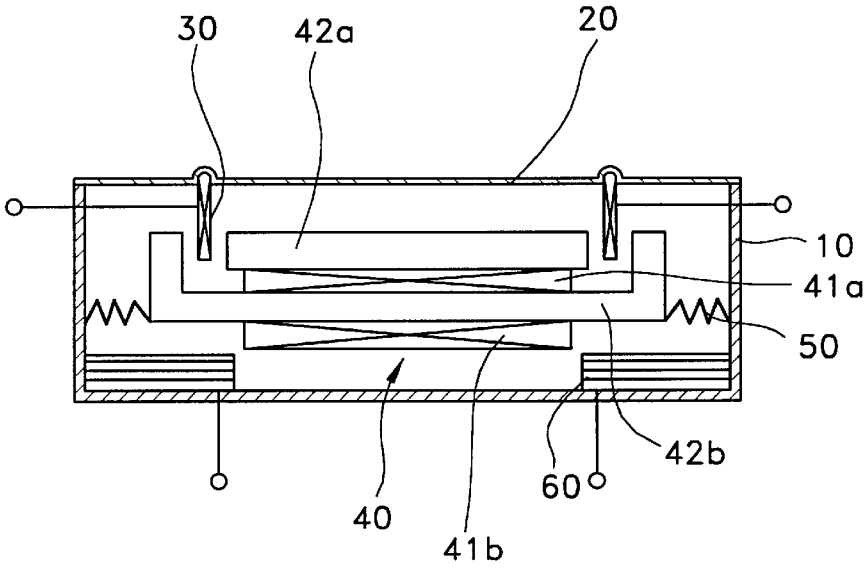
FIG. 9 is a side cross sectional view showing another example of vibration member in FIG. 5 vibration speaker.

And in layout explained above, it is also possible to make formation of magnet 41 as in FIG. 9 where, with reference to second yoke 42*b* under magnet 41, first magnet 41*a* and second magnet 41*b* are attached to top and bottom surfaces of second yoke 42*b* respectively whence the very preferable mode is to arrange magnets so that poles of first magnet 41*a* and second magnet 41*b* are positioned in the same sequence.

Accordingly because vibration member 40 is left in state separated with definite gap from voice coil 30 by yoke 42 so that vibration member 40 is in suspended state in space within case 10, vibration member 40 shall be connected by separate elastic member 50 but not with case 10 only.

Figure 10:
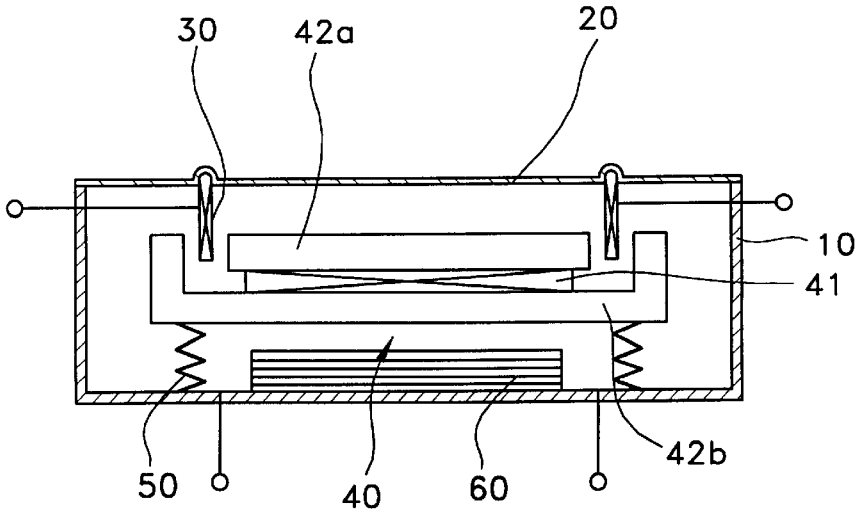
FIG. 10 is a side cross sectional view showing another example of elastic member in FIG. 5 vibration speaker.

Whence elastic member 50 may connect vibration member 40 to side surface of case 10 or may settle the member upon case 10 bottom surface as to be joined so as in FIG. 10.

Figure 8:
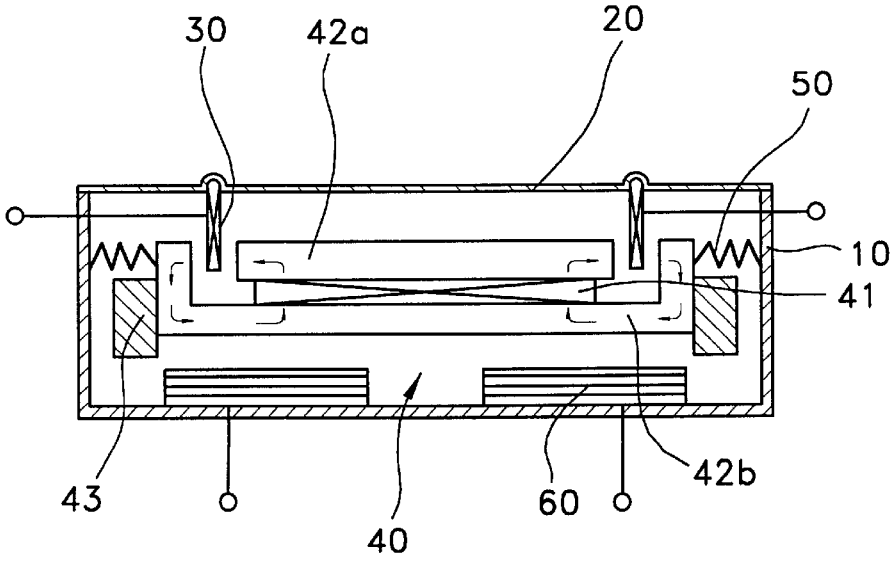
FIG. 8 is a side cross sectional view showing the condition where vibration member in FIG. 5 is combined with weight that is mass body.

Whereupon it is preferable to contain mass body of definite size in order to augment vibration amplitude according to vibration because vibration member 40 explained above is in status supported by elastic member 50 wherefore an example is presented in present invention as shown in FIG. 8 where ring-shaped weight 43 is combined on second yoke 42*b* circumference. It is preferable that such weight 43 be made of stuff not affected by magnetic flux.

Meanwhile coil 60 to generate vibration is single-phase wound coil separated with definite gap from vibration member 40 bottom part but attached upon case 10 bottom surface whence low-frequency electric current is applied to coil 60 to generate vibration.

Coil 60 to generate vibration may be widely formed upon case 10 bottom surface, which coil 60 has wound formation so that magnetic field be formed in only one direction when electrified.

Vibration speaker of such layout allows sound and vibration performances to be maximized as described above by way of letting signal for sound generation to be applied at voice coil 30 and letting signal for vibration generation to be applied at coil 60 to generate vibration.

Figure 11:
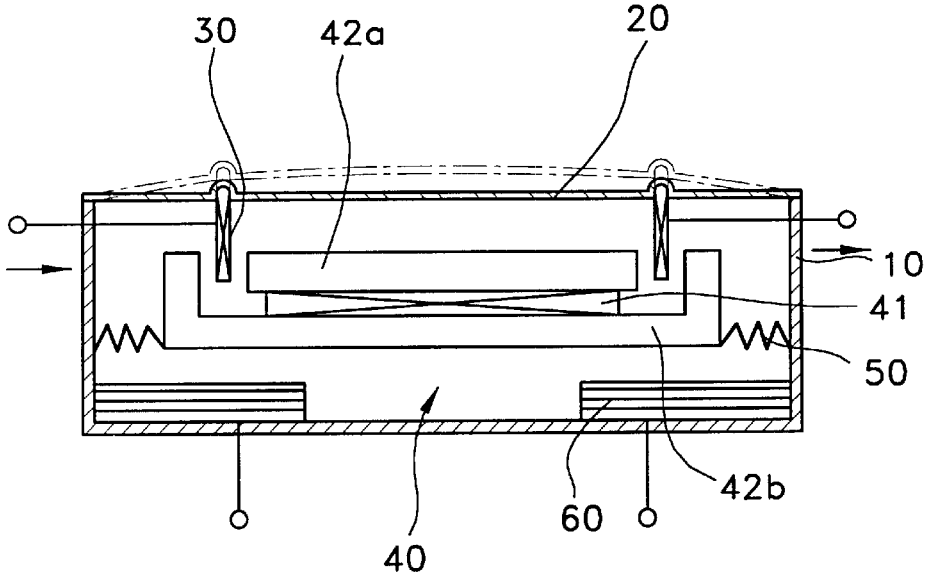
FIG. 11 is a side cross sectional view showing the status when high frequency signal is applied to vibration speaker of the present invention.

Namely high-frequency electric current is applied to voice coil 30 and it becomes electrified state as in FIG. 11 when signal inputted from outside is signal for sound generation whence action of pulling or pushing voice coil 30 is very rapidly executed by interaction between magnetic field generated at this time and magnetic field formed by yoke 42 and magnet 41 of vibration member 40 furnished under voice coil 30.

According to this, sound is generated as vibration plate 20 oscillates violently to which voice coil 30 has been attached.

Figure 12:
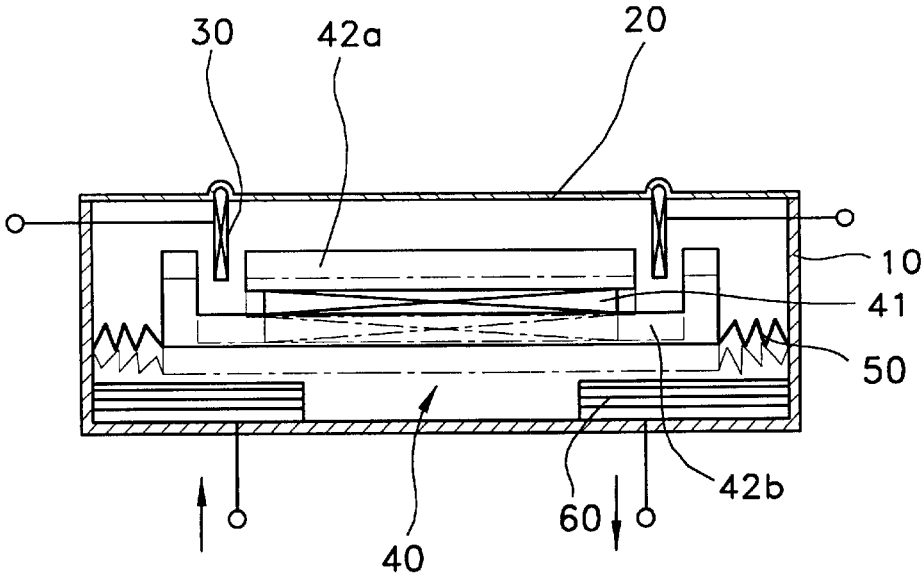
FIG. 12 is side cross sectional view showing the status when low frequency signal is applied to vibration speaker of present invention.

On other hand low frequency current is applied to coil 60 to generate vibration and it becomes electrified state as in FIG. 12 when signal inputted from outside is signal for vibration generation whence action of pulling or pushing the vibration member 40 in vertical direction is very rapidly executed by interaction between magnetic field generated at this time and magnetic field formed by yoke 42 and magnet 41 of vibration member 40.

Particularly because coil 60 to generate vibration is very widely formed upon case 10 bottom surface, magnetic field formed by coil 60 to generate vibration can make more powerful electromagnetic force than magnetic field formed by voice coil 30.

And though, because coil 60 to generate vibration is formed in single phase, only one kind of polarity will be exhibited as a whole, but because electric current flowing in coil 60 to generate vibration is alternating current, eventually it becomes state that N and S polarities are consecutively alternated continuously.

Accordingly if thus N and S polarities are continuously alternated by coil 60 to generate vibration against vibration member 40 that consistently exhibits only one kind of polarity according to magnet 41, vibration member 40 and coil 60 to generate vibration repeats action to pull or push each other.

Meanwhile, because coil 60 to generate vibration has been attached upon inside bottom surface of case 10, eventually vibration member 40 furnished to be able to move or float goes up and down, whence vibration force of this vibration member 40 is transmitted through elastic member 50 connected to case 10 so that vibration signal may be sufficiently sensed from outside.

Figure 13:
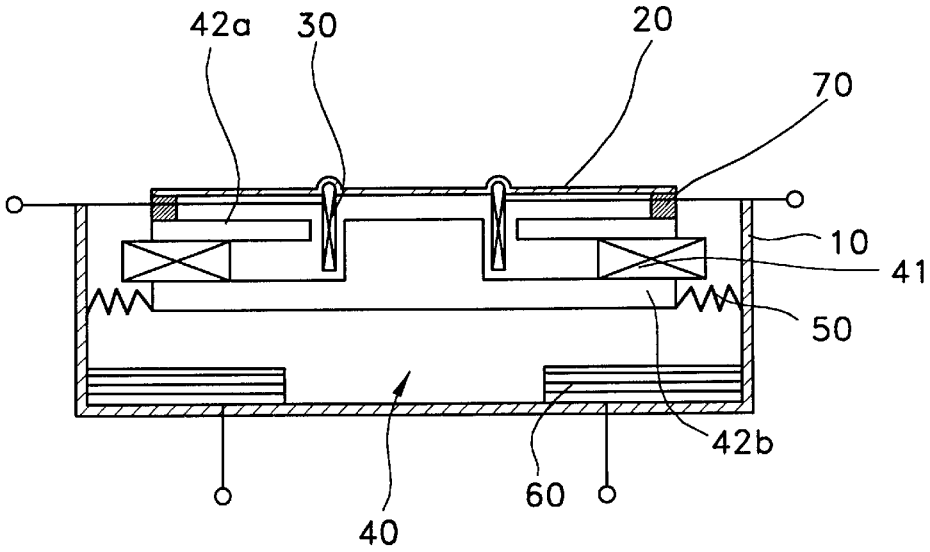
FIG. 13 is a side cross sectional view showing another vibration speaker example according to the present invention.

FIG. 13 shows another example according to the present invention, the formation of which vibration speaker example is same as that of the example described above, where vibration member 40 is composed by a magnet 41 to which first yoke 42*a* and second yoke 42*b* are attached respectively over and under magnet 41.

But only here magnet 41 is made ring type or doughnut type; inner diameter of first yoke 42*a* attached to magnet 41 top surface is made a little larger than outer diameter of voice coil 30 so that first yoke 42*a* maintains separated state with definite gap from voice coil 30; and second yoke 42*b* attached to magnet 41 bottom surface is made to protrude upward in its central part with smaller diameter than inner diameter of voice coil 30 so that this protruded central part is inserted in inner diameter of lower part of voice coil 30 but maintains separated state with definite gap from voice coil 30.

And this layout features that a separate ring-shaped supporting member 70 with definite height is attached to outside edge part of magnet 41 top surface, to top of which supporting member 70 is connected the outside edge part of vibration plate 20 adfixed having attached the voice coil 30.

In this layout also it may be that vibration member 40 is elastically supported by elastic member 50 from case 10, to which bottom surface of vibration member 40 is attached a coil 60 to generate vibration in same manner as the example described before, and particularly a separate magnet 41 having same pole direction with existing magnet 41 attached to upper side may be attached to yoke 42 bottom surface on lower side of vibration member 40, facing the coil 60 to generate vibration.

Formation in this example is same as that in examples described hitherto where high-frequency electric current is applied to voice coil 30 when signal inputted from outside is signal for sound generation while low-frequency electric current is applied to coil 60 to generate vibration when signal inputted from outside is signal for vibration generation.

But only in this example, because vibration plate 20 is furnished in combination with vibration member 40, eventually vibration member 40 weight is increased so that it makes effect that vibration amount of vibration member 40 is rather augmented when vibration member 40 is driven up and down as low-frequency electric current is applied to coil 60 to generate vibration.

Figure 14:
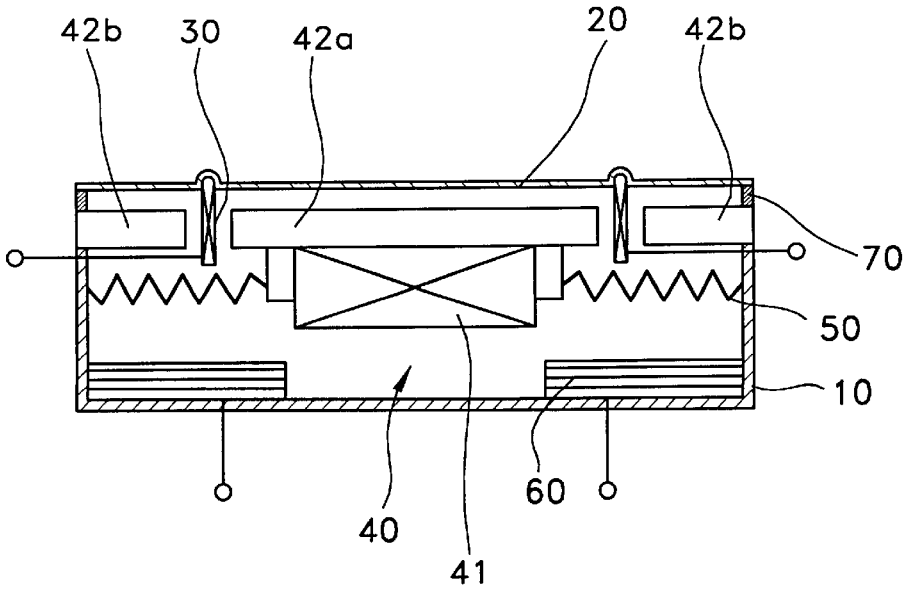
FIG. 14 is a side cross sectional view showing another vibration speaker example according to the present invention.

FIG. 14 shows another example of present invention where it is same as above examples that vibration member 40 is composed by magnet 41 and yoke 42 but it has layout that first yoke 42*a* is attached upon magnet 41, which yoke 42*a* has outer diameter smaller than inner diameter of voice coil 30 while second yoke 42*b* is attached to case 10 at same horizontal level as first yoke 42*a*, which yoke 42*b* has inner diameter larger than outer diameter of voice coil 30.

Whence it has feature that a separate ring-shaped supporting member 70 is attached to outside edge part of top surface of second yoke 42*b* furnished to outside of voice coil 30, to which supporting member 70 the outside edge part of vibration plate 20 having attached voice coil 30 is firmly adfixed.

Meanwhile in this example also vibration member 40 is elastically supported by elastic member 50 from case 10, to which bottom surface of vibration member 40 is attached a coil 60 to generate vibration in same manner as the example described above.

But only in present example first yoke 42*a* and second yoke 42*b* are positioned on same horizontal level so that magnet 41 having attached first yoke 42*a* directly faces coil 60 to generate vibration.

This kind of layout has advantage to rather slimmerize vibration member 40 thickness so as to make effect vibration speaker be more slimmerized in total thickness.

Meanwhile in present example also as described hitherto high-frequency electric current is applied to voice coil 30 when signal inputted from outside is signal for sound generation while low-frequency electric current is applied to coil 60 to generate vibration when signal inputted from outside is signal for vibration generation.

Accordingly sound is generated by moving up and down according to interaction vibration member 40 to oscillate vibration plate 20 as high-frequency electric current is applied to voice coil 30 whereas, when low-frequency electric current is applied to coil 60 to generate vibration, vibration member 40 is driven up and down according to interaction vibration member 40 so that a greater vibration force through elastic member 50 is transmitted through case 10.

Thus the greatest advantage of present invention is to maximize force of interaction with vibration member 40 particularly by placing coil 60 to generate vibration under magnet 41 of vibration member 40 as layout generates sound or vibration by electric current applied to voice coil 30 and coil 60 to generate vibration respectively according to signal inputted from outside.

And greater vibration force can be exerted than when vibration member 40 took seesaw action as in former invention applied from present applicant if vibration member 40 is driven up and down by thus augmented active force.

Therefore present invention can drastically enhance product reliability and promote product slimmerization at same time by maximizing sound and vibration performance according to a simple structure improvement of maximizing mutual facing area with vibration member 40 while making the coil 60 for generation of vibration in single phase.

What is claimed is:

1. A vibration speaker comprising:

a case;

a vibration plate in order to generate sound, the outside edge of which vibration plate is affixed to top part of said case;

a voice coil wound cylindrically whose top is affixed to said vibration plate;

a vibration member composed of a magnet and a yoke which said vibration member is furnished under the voice coil, which said magnet is polarized up and down into N and S poles, and which said yoke constitutes a magnetic circuit, having been attached to said magnet;

an elastic member that elastically supports between said vibration member and said case so that said vibration member may move up and down vertically; and a coil of single phase to generate vibration which coil is attached to bottom surface of said case, facing said vibration member at bottom part of said vibration member so that said coil may drive said vibration member up and down vertically so as to be essentially free of rocking motion by interaction with said vibration member.

2. The vibration speaker in claim 1, wherein several sound discharge holes of definite size are formed at one side surface of said case.

3. The vibration speaker in claim 2, wherein throughhole of definite size is formed on one side surface of said second yoke so as to augment leaked magnetic flux of said magnet.

4. The vibration speaker in claim 2, wherein said vibration member is furnished with a first magnet where N and S poles are polarized up and down respectively between said first yoke and said second yoke while said second magnet having same polarization structure with said first magnet is attached on bottom surface of said second yoke attached on bottom surface of said first magnet so that said second magnet faces said coil to generate vibration which coil is attached to bottom surface of said case so that said magnet and said coil interact with each other.

5. The vibration speaker in claim 2, wherein a weight having definite mass is attached at outside side surface of said vibration member.

6. The vibration speaker in claim 1, wherein a first yoke and a second yoke are attached respectively to top and bottom surfaces of said magnet of said vibration member where said first yoke attached to top surface of said magnet has smaller outside diameter than inner diameter of said voice coil so that said first yoke is inserted in lower part of said voice coil while outside edge part of said second yoke attached to bottom surface of said magnet is folded upward, which folded top part of said second yoke is positioned on same horizontal level with outside edge part of said first yoke so as to form said magnetic circuit.

7. A vibration speaker comprising:

a case;

a vibration member where are furnished a ring-shaped magnet polarized up and down respectively into N and S poles, a first yoke attached to top surface of said magnet and having a center penetrated through vertically, and a second yoke to constitute magnetic circuit, the outer circumference surface of which said second yoke is attached to bottom surface of said magnet while the center part of said second yoke has outer diameter protruded upward separated by definite gap from inner diameter surface of said first yoke, which protruded upper end part shall be positioned on same horizontal level with inner diameter surface of said first yoke;

a ring-shaped supporting member attached to outside edge part of top surface of said first yoke of said vibration member;

a vibration plate to generate sound, whose outside edge part is attached to said supporting member;

a cylindrically wound voice coil whose top is adfixed to said vibration plate, whose outer circumferential surface of lower part faces the inner diameter surface of said first yoke, and whose inner circumferential surface of lower part faces the outer circumferential surface of upward protruded edge part of said second yoke;

an elastic member between said vibration member and said case, elastically supporting that said vibration member be driven up and down vertically; and a single phase coil to generate vibration, attached onto bottom surface of said case, facing said vibration member at bottom part of said vibration member, making said vibration member to be driven up and down according to interaction with said vibration member.

8. The vibration speaker in claim 7, wherein said vibration member is furnished with a first magnet between said first yoke and said second yoke which said magnet is polarized up and down respectively into N and S poles, and then a second magnet having same polarization structure with said first magnet is attached onto bottom surface of said second yoke attached to bottom surface of said first magnet so that said second magnet may interact facing said coil to generate vibration that is attached onto bottom surface of said case.

9. A vibration speaker comprising:

a case;

a vibration member where are furnished a cylindrical magnet polarized up and down respectively into N and S poles, first yoke attached to top surface of said magnet, and second yoke to constitute magnetic circuit, the inner diameter surface of which second yoke is positioned opposedly with outer diameter surface of said first yoke by a definite gap, and the outside edge part of which second yoke is attached to upper part of said case;

a ring-shaped supporting member attached to outside edge part of top surface of said second yoke of said vibration member;

a vibration plate to generate sound, whose outside edge part is attached to said supporting member;

a cylindrically wound voice coil whose top is affixed to said vibration plate, whose outer circumferential surface of lower part faces the inner diameter surface of said second yoke, and whose inner circumferential surface of lower part faces the outer circumferential surface of said first yoke;

an elastic member between said vibration member and said case, elastically supporting that said vibration member be driven up and down vertically; and a single phase coil to generate vibration, attached onto bottom surface of said case, facing said vibration member at bottom part of said vibration member, making said vibration member to be driven up and down according to interaction with said vibration member.

10. The vibration speaker in claim 1, wherein a weight having definite mass is attached at outside side surface of said vibration member.

* * * * *